US006390585B1

(12) United States Patent
Schiaffino et al.

(10) Patent No.: US 6,390,585 B1
(45) Date of Patent: May 21, 2002

(54) SELECTIVELY WARMING A PRINTHEAD FOR OPTIMIZED PERFORMANCE

(75) Inventors: Stefano Schiaffino, Milan (IT); Sebastia Castelltort, Igualada; David H. Donovan, Barcelona, both of (ES)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/120,858

(22) Filed: Jul. 21, 1998

(51) Int. Cl.[7] ..... B41J 29/38
(52) U.S. Cl. ..... 347/17; 347/5; 347/14
(58) Field of Search ..... 347/5, 14, 17, 347/19, 85, 86, 191, 194, 195

(56) References Cited

U.S. PATENT DOCUMENTS

| | | | | |
|---|---|---|---|---|
| 4,536,774 A | * | 8/1985 | Inui et al. | 347/17 |
| 4,791,435 A | | 12/1988 | Smith et al. | 346/140 |
| 4,910,528 A | | 3/1990 | Firl et al. | 346/1.1 |
| 5,075,690 A | | 12/1991 | Kneezel | 346/1.1 |
| 5,107,276 A | | 4/1992 | Kneezel et al. | 346/1.1 |
| 5,235,346 A | | 8/1993 | Yeung | 346/76 PH |
| 5,648,806 A | | 7/1997 | Steinfield et al. | 347/87 |
| 5,675,367 A | | 10/1997 | Scheffelin et al. | 347/86 |
| 5,736,995 A | * | 4/1998 | Bohorquez et al. | 347/17 |
| 6,161,915 A | * | 12/2000 | Bolash et al. | 347/19 |

* cited by examiner

*Primary Examiner*—John Barlow
*Assistant Examiner*—An H. Do
(74) *Attorney, Agent, or Firm*—Skjerven Morrill MacPherson LLP; Philip W. Woo

(57) ABSTRACT

A system and method are provided for selectively warming a printhead in response to a relatively sudden change in one or more operating conditions of a printer. These operating conditions may include, for example, duty cycle, print density, print speed, and the like, which can be empirically detected, calculated, or predicted. Because sudden changes in printing conditions generally do not occur frequently, the printhead will not be warmed at all for much of its operating time. This reduces dramatic fluctuations in drop volume, to prevent thermal banding, while not maintaining the printhead at an undesirably high temperature.

26 Claims, 9 Drawing Sheets

SELECTIVELY WARMING A PRINTHEAD FOR OPTIMIZED PERFORMANCE

CROSS REFERENCE TO RELATED APPLICATIONS

This Application relates to the subject matter disclosed in the following United States Patents and co-pending United States Applications:

U.S. Pat. No. 4,791,435 to Smith, et al., entitled "Thermal Inkjet Printhead Temperature Control;"

U.S. Pat. No. 4,910,528 to Firl, et al., entitled "Ink Jet Printer Thermal Control System;"

U.S. Pat. No. 5,235,346 to Yeung, entitled "Method and Apparatus For Controlling the Temperature of Thermal Ink Jet and Thermal Printheads That Have a Heating Matrix System;"

U.S. Pat. No. 5,648,806 to Steinfield, et al., entitled "Stable Substrate Structure For A Wide Swath Nozzle Array In A High Resolution Ink Jet Printer;"

U.S. application Ser. No. 08/706,051, filed Aug. 30, 1996, entitled "Printer Using Print Cartridge With Internal Pressure Regulator;"

U.S. Pat. No. 5,675,367 to Scheffelin, et al., entitled "Ink Jet Print Cartridge Having Handle Which Incorporates An Ink Fill Port;"

U.S. Pat. No. 5,736,995 to Bohorquez, et al., entitled "Temperature Control of Thermal Inkjet Printheads By Using Synchronous Non-Nucleating Pulses;" and United States Application filed herewith, entitled "Variable Maximum Operating Temperature For a Printhead," by Schiaffino, et al.

The above patents and co-pending applications are assigned to the present Assignee and are incorporated herein by reference.

TECHNICAL FIELD OF THE INVENTION

The present invention generally relates to ink jet and other types of printers and, more particularly, to a system and method for selectively warming a printhead for optimized performance.

BACKGROUND OF THE INVENTION

Many modem printing devices incorporate thermal ink jet technology. Typically, this technology utilizes a printhead (also known as a pen) having a silicon die supporting one or more vaporization chambers. During operation, resistors or other ink ejection elements on the silicon die are heated in order to vaporize and eject ink through nozzles overlying the vaporization chambers, thereby causing dots of ink to be printed on a recording medium, such as paper.

In general, the temperature of a printhead will change or fluctuate while printing. When a printer is printing "light" areas or in a slow mode, the printhead temperature will drop; when a printer is printing "dense" areas or in a fast mode, the printhead temperature will rise. As the printhead temperature changes, the amount of ink ejected from any given vaporization chamber (commonly referred to as the "drop volume") will also change. In particular, a rise in printhead temperature causes an increase in drop volume, while a fall in temperature causes a decrease in drop volume.

This relationship between temperature and drop volume can affect the print quality of a printer. Specifically, large changes in printhead temperature may cause thermal banding—i.e., a shift in color saturation or hue attributable to changes in drop volume. Thermal banding is very pronounced in, for example, a sign plot, as illustrated in FIG. 1, where a dark background is printed on a lightly-colored medium to form a large, lightly-colored letter.

FIG. 1 depicts a lightly-colored letter "I" bordered by a darkly-colored background. In an exemplary operation for the printing of such letter using a large format printer, a recording medium is incrementally advanced from left to right (as indicated by arrow 1 designated "Paper Advance"). During each increment, a printhead is scanned from bottom to top (as indicated by the arrow 2 designated "Print Axis") as it is being energized to deposit a swath of ink thereon. In the scans where no portion of the letter "I" is present, such as at areas 3 and 4, the printhead is fired very rapidly for a relatively long period. This causes the temperature of the printhead to rise, which, in turn, increases the drop volume. Accordingly, areas 3 and 4 appear dark, with deep color saturation into the recording medium. In contrast, for scans in which a portion of the letter is formed, such as at area 5, the printhead is fired, on average, less frequently. The temperature of the printhead remains relatively cool, and thus, less ink is deposited onto the medium. Accordingly, this area appears faded or "washed out" because color saturation is not as great. The noticeable difference in color saturation between areas with and without letters is considered to be a serious printing defect.

To mitigate the problem described above, a number of techniques have been previously developed. According to one previous technique, commonly known as pre-swath warming (PSW), the temperature of a printhead is raised to the same, predetermined value at the beginning of each scan of the printhead. This could be accomplished by "dry firing" the resistors on a silicon die of the printhead to produce heat. However, because the printhead temperature is allowed to vary during each scan (after having been heated to the same, predetermined temperature at the beginning of each scan), the PSW technique does not control temperature adequately enough to mitigate the effects of thermal banding.

According to another previous technique, commonly referred to as smart pulse warming (SPW), the printhead temperature is continuously measured and warmed to a fixed, predetermined value at all times during printing. This value is approximately equal to a temperature experienced during maximum print densities. Like the PSW technique, the SPW technique also heats the printhead by dry firing resistors on the silicon die. The fixed printhead temperature under the SPW technique is required to be set at a value well-above common operating temperatures. This is problematic in that the continuous operation of a printhead at a high temperature adversely impacts upon the life of the printhead and its performance.

SUMMARY

The disadvantages and problems associated with controlling or regulating the temperature of a printhead to mitigate the effects of thermal banding have been substantially reduced or eliminated using the present invention.

In accordance with one embodiment of the present invention, a system includes an operating condition sensor for generating a present value corresponding to an operating condition (e.g., printing density, print speed, etc.) within a printer. A memory stores at least one historical value for the operating condition. A controller, coupled to the operating condition sensor and the memory, calculates the amount of change in the operating condition between the present and historical values. The controller then initiates warming of a printhead in response to the calculated amount of change.

Important technical advantages of the present invention include selectively warming a printhead in response to relatively sudden changes in the operating conditions and/or characteristics of a printer, wherein a printer condition is something which can be detected and a printer characteristic is something which can be calculated or predicted from one or more printer conditions. This selective warming avoids thermal banding. Specifically, a printhead is warmed only upon the occurrence, within a predefined interval, of at least a predetermined amount of change in any one, or a combination, of various printer conditions or characteristics, such as duty cycle, print density, print speed, and the like, which can be empirically detected, calculated, or predicted. The print speed of a printer can be fast or slow, depending upon the quality of print desired. The duty cycle is a measurement derived from, among other thing, the print density and the number of scans. Because sudden changes in printing conditions and characteristics generally do not occur frequently, the printhead will not be warmed at all for much of its operating time. This reduces dramatic fluctuations in drop volume, while not maintaining a printhead at an undesirably high temperature. Accordingly, the present invention mitigates the effects of thermal banding without adversely impacting upon the life and performance of a printhead. Other important technical advantages are readily apparent to one skilled in the art from the following figures, descriptions, and claims.

BRIEF DESCRIPTION OF THE DRAWINGS

For a more complete understanding of the present invention and for further features and advantages, reference is now made to the following description taken in conjunction with the accompanying drawings, in which.

DETAILED DESCRIPTION OF THE PREFERRED EMBODIMENTS

The preferred embodiments of the present invention and their advantages are best understood by referring to FIGS. 2–10 of the drawings. Like numerals are used for like and corresponding parts of the various drawings.

Figure 1:
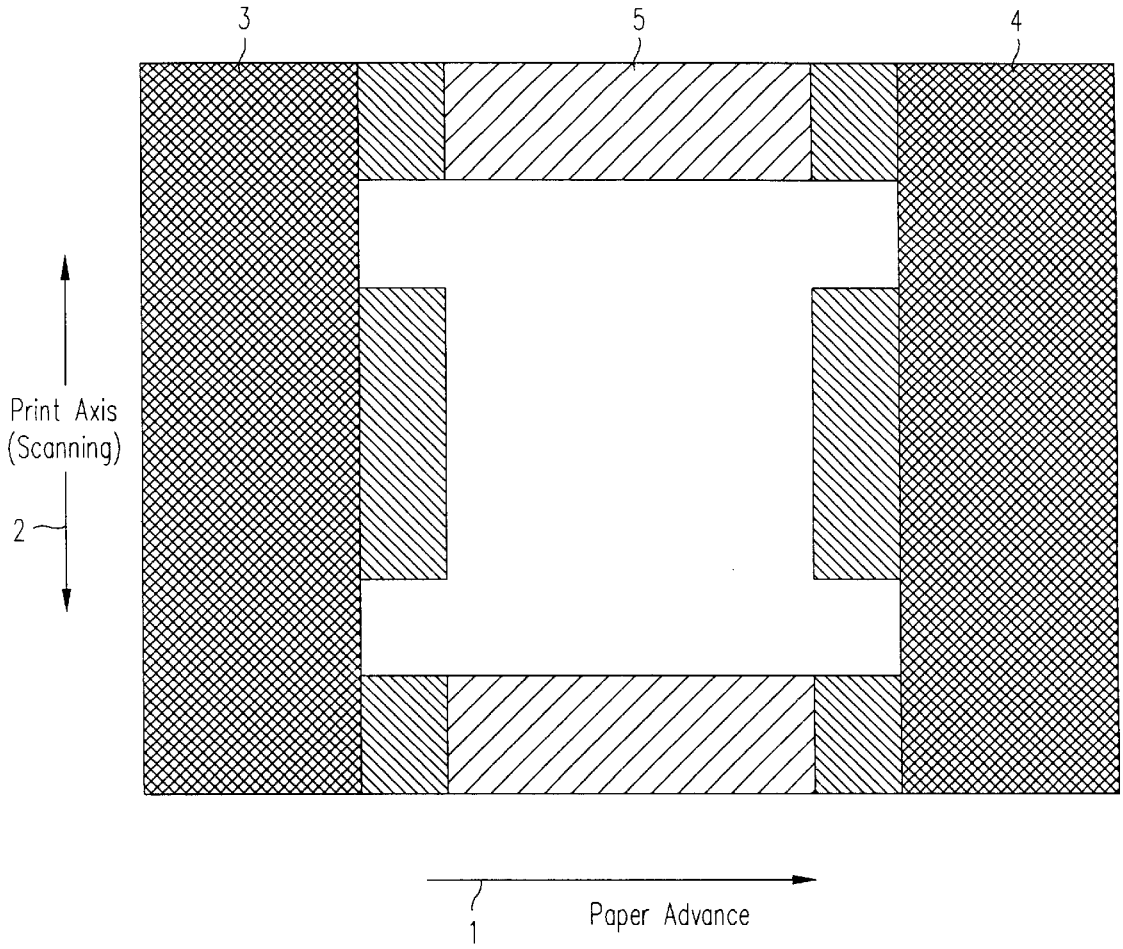
FIG. 1 illustrates the effects of thermal banding in an exemplary printing of a dark background to define a lightly-colored letter.
Figure 2:
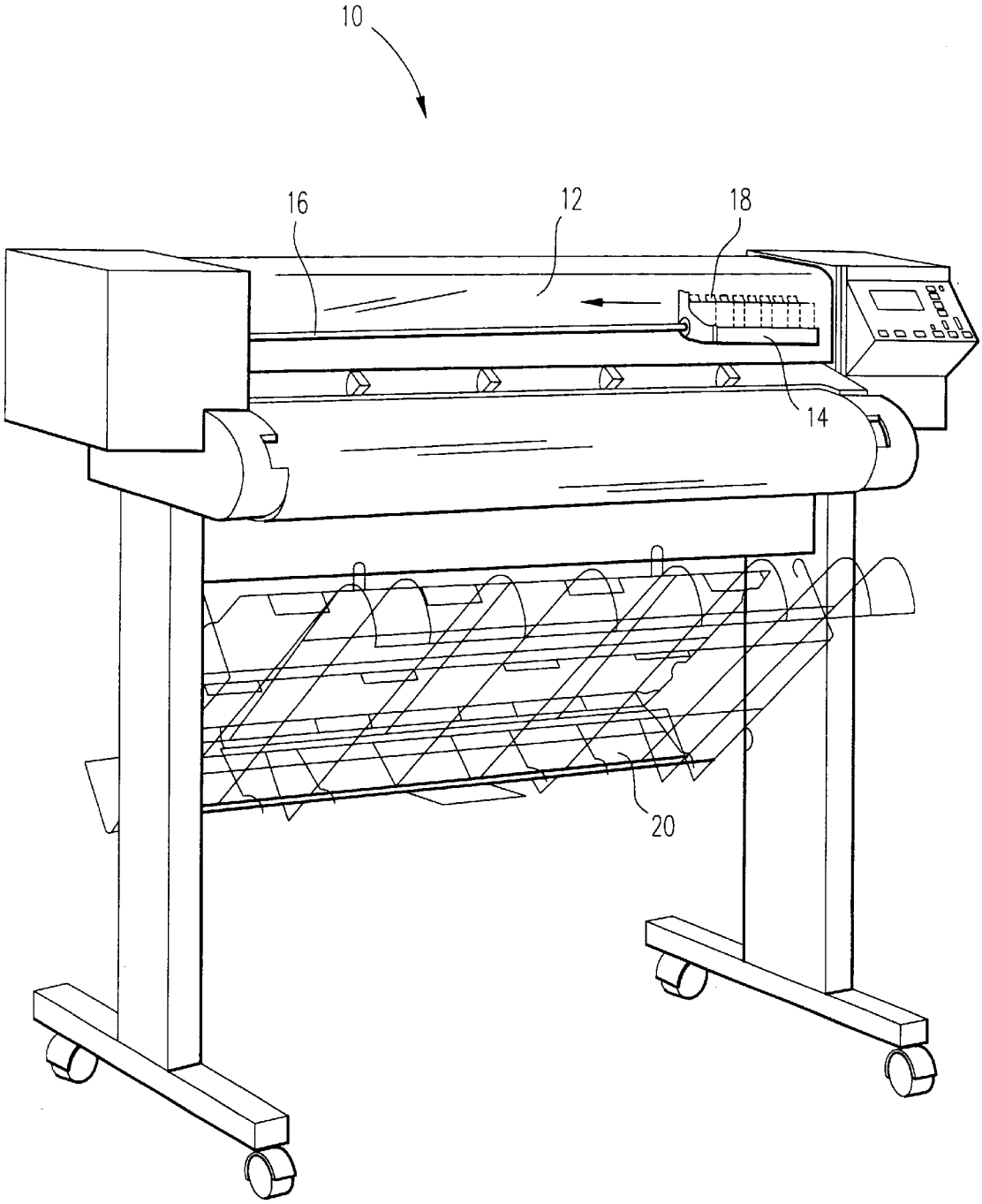
FIG. 2 illustrates an exemplary printer into which a system of the present invention can be incorporated.

Even though the invention can be used in any printing environment which incorporates thermal ink-jet technology, the presently preferred embodiment of the invention is used in a large format, ink jet printer 10 of the type illustrated in FIG. 2. Ink jet printer 10 includes print zone 12 within which a movable carriage 14 rides along a slide rod 16. A stepper motor (not shown), connected to carriage 14 using a conventional drive belt and pulley arrangement, is used for transporting carriage 14 across print zone 12. A scanning mechanism (not shown) may include a coded strip which is optically detected by a photodetector in carriage 14 for precisely positioning the carriage. One or more print cartridges 18 are held in carriage 14. Print cartridges 18 can hold inks of different colors, such as yellow, magenta, cyan, and black. In one embodiment, each print cartridge 18 prints at 600 dots per inch (dpi). More details of an exemplary print cartridge 18 are described below with reference to FIG. 3. A tray 20 may support a wide, continuous roll of paper.

In operation, paper from tray 20 is fed into ink jet printer 10. The paper is stopped in print zone 12 where carriage 14, containing print cartridges 18, is then scanned across the paper for printing a swath of ink thereon. After a single scan or multiple scans over one position within print zone 12, the paper is incrementally shifted using a conventional motor and feed rollers to a next position, and then carriage 14 again scans across the paper for printing a next swath of ink. When printing on the paper is complete, the paper is forwarded out of print zone 12, and held in a position that allows the ink to dry.

Figure 3:
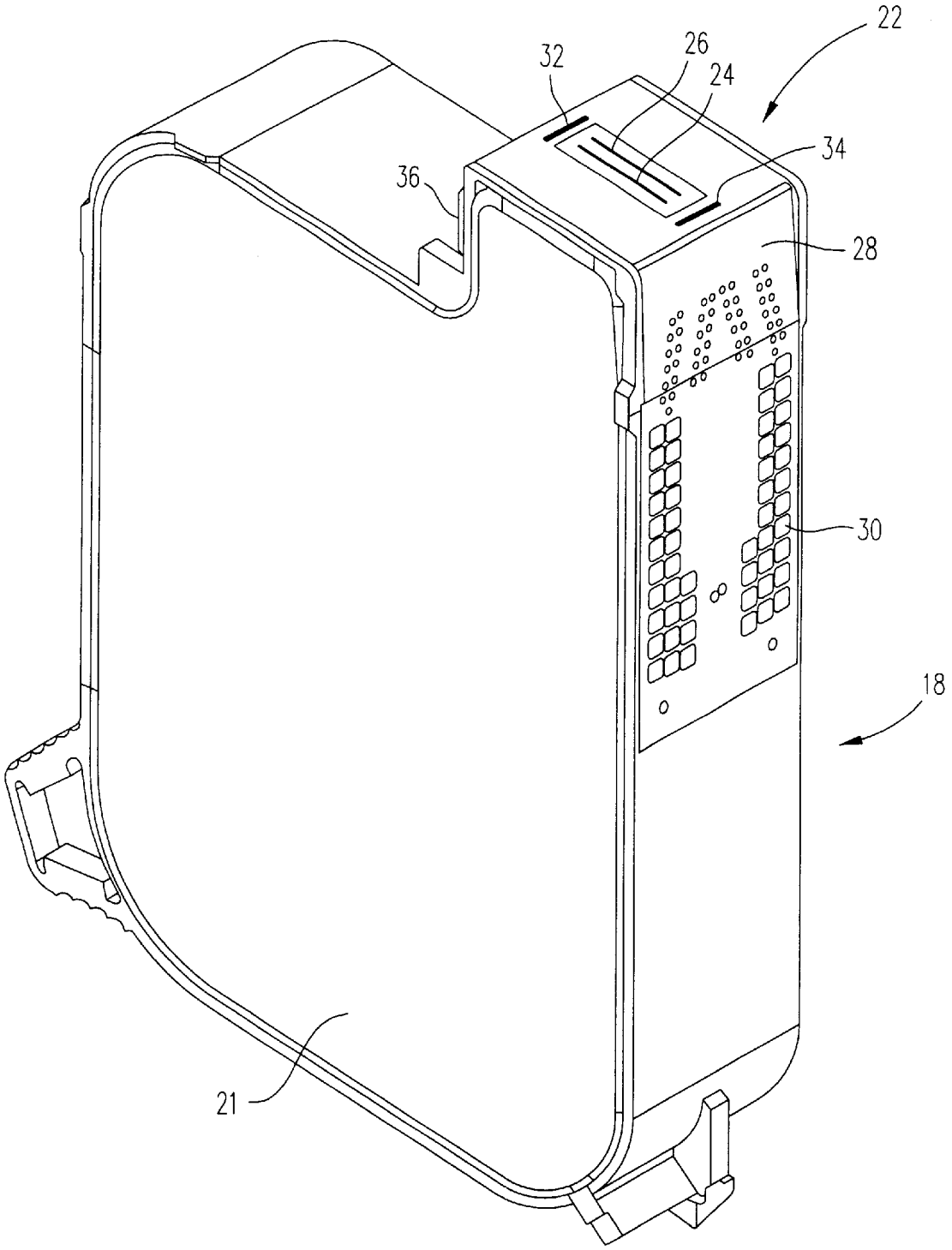
FIG. 3 illustrates an exemplary print cartridge, including a printhead which can be selectively warmed according to the present invention.

FIG. 3 illustrates an exemplary print cartridge 18 which may be incorporated into an ink jet printer, such as that shown in FIG. 2. Referring to FIG. 3, print cartridge 18 comprises an ink reservoir 21 and a printhead 22. Ink reservoir 21 stores a supply of ink, which may be refilled or replenished as necessary, such as by a flexible tube leading to a stationary ink supply. Printhead 22 functions to eject ink onto a print medium, such as paper. In accordance with the present invention, printhead 22 may be warmed in response to sudden changes in the operating conditions of a printer into which print cartridge 18 is incorporated.

Printhead 22 is situated in a "snout" of print cartridge 18 and may be formed using a process known as Tape Automated Bonding (TAB). Printhead 22 includes a nozzle member 24 comprising one or more columns of offset holes or orifices 26 formed in a flexible polymer circuit 28 by, for example, laser ablation. Although not expressly shown, behind each of orifices 26 lies a vaporization chamber which is heated by resistors on or within a silicon substrate or die of printhead 22.

One or more contact pads 30, designed to interconnect with electrodes on a printer, are formed on a front surface of flexible polymer circuit 28. Each of contact pads 30 terminates one end of various conductive traces (not shown) formed on a back surface of flexible polymer circuit 28 using a conventional photolithographic etching and/or plating process. Contact pads 30 and the conductive traces cooperate to provide externally generated energization signals to printhead 22.

Windows 32 and 34 extend through flexible circuit 28 and are used to facilitate bonding of the other ends of the conductive traces to electrodes on the silicon substrate containing heating resistors. Windows 32 and 34 are filled with an encapsulant to protect any underlying portion of the conductive traces and the substrate.

Flexible circuit 28 is bent over a back wall 36 of the print cartridge "snout" and extends approximately one half the length of back wall. This portion of flexible circuit 28 is needed for the routing of conductive traces which are connected to the substrate electrodes through the far end window 32. In particular, conductive traces, connected to contact pads 30, are routed over the bend and then connected to the substrate electrodes through windows 32 and 34 in flexible circuit 28.

Additional detail regarding print cartridge 18 is found in U.S. Pat. No. 5,648,806, entitled "Stable Substrate Structure for a Wide Swath Nozzle Array in a High Resolution Inkjet Printer," issued to Steven W. Steinfield, et al., assigned to the present assignee and incorporated herein by reference.

Generally speaking, the present invention provides an improved technique for warming a printhead in order to mitigate the effects of thermal banding. The present invention recognizes that the effects of thermal banding are most noticeable when there is a sudden change or transition in various operating conditions or characteristics of a printer, wherein a printer condition is something which can be detected and a printer characteristic is something which can be calculated or predicted from one or more printer conditions. For example, if a printer suddenly shifts from operating in a fast print mode (i.e., relatively fast scanning and/or firing speed) to a slow print mode (i.e., relatively slow scanning and/or firing speed), there will be a rapid decrease in the drop volume due to the accompanying fall in printhead temperature.

Given this relationship between changes in the operating conditions/characteristics of a printer and the effects of thermal banding, one embodiment of the present invention selectively warms a printhead in response to sudden or rapid changes in the operating conditions/characteristics of a printer. Specifically, a printhead is warmed only upon the occurrence, within a predefined interval, of at least a predetermined amount of change in any one, or a combination, of various printer conditions/characteristics, such as duty cycle, print density, print speed, and the like, which can be empirically detected, calculated, or predicted. Because such rapid changes in printing conditions/characteristics do not occur frequently, the printhead will not be warmed at all for much of its operating time. Accordingly, the printhead remains at a lower average temperature, while still reducing dramatic fluctuations in drop volume. In this way, the present invention mitigates the effects of thermal banding without adversely impacting upon the life and performance of a printhead.

As discussed herein, the predefined interval can be any suitable period of time for monitoring changes in printer condition(s)/characteristic(s) and, preferably, corresponds to the time required for at least a set number of print scans. The predetermined amount of change is such that, if it was to occur within the predefined interval and in the absence of the present invention, the effects of thermal banding would be noticeable upon a recording medium. The predefined time interval and the predetermined amount of change in one or more relevant operating conditions/characteristics constitute "triggering" events in that the warming of a printhead will be initiated upon their occurrence.

Although a number of different printing conditions/characteristics are recited herein, tests have shown that the thermal characterization for a printhead closely follows the duty cycle for a printer. The duty cycle is derived from the carriage velocity (i.e., the speed at which a print cartridge carriage moves along a slide rod), the print area density (i.e., how much ink is to be deposited onto a particular area of printing), and the number of passes or scans of the carriage. In particular, the duty cycle (dc) may be defined by the following equation:

$$dc = AD\frac{V_{carr}}{n_{pass}} \tag{1}$$

where AD is the print area density, $V_{carr}$ is the carriage velocity, and $n_{pass}$ is the number of passes. A high duty cycle generally corresponds to a high normal operating temperature for a printhead, whereas a low duty cycle generally corresponds to a low normal operating temperature.

In one embodiment, the duty cycle can be measured or calculated for each of a number of print swaths or scans, and a record of its variations kept in a memory. When the duty cycle suddenly decreases, the printhead will be warmed to prevent a rapid fall in printhead temperature and drop volume. Accordingly, the effects of thermal banding are mitigated or substantially reduced.

In another embodiment, an average value for the duty cycle is derived or calculated for the most recent scans. A printhead temperature corresponding to this average duty cycle is then used as a threshold or trigger for smart pulse warming (SPW) of the printhead. Because the average value for the duty cycle varies with the print scans, the trigger temperature also varies. Generally, the printer will be operating with a printhead temperature above the applicable threshold or trigger temperature. If at any point, however, the actual temperature of the printhead falls below the applicable threshold or trigger, SPW is activated to prevent a sudden drop in printhead temperature and drop volume.

Although various embodiments have been illustrated and discussed above, it should be understood that the present invention is not so limited. Thus, for example, the warming of a printhead can be initiated upon predicted, future printing conditions or characteristics. This can be accomplished by forecasting sudden changes in duty cycle using the information held in a buffer memory of the printer.

Figure 4:
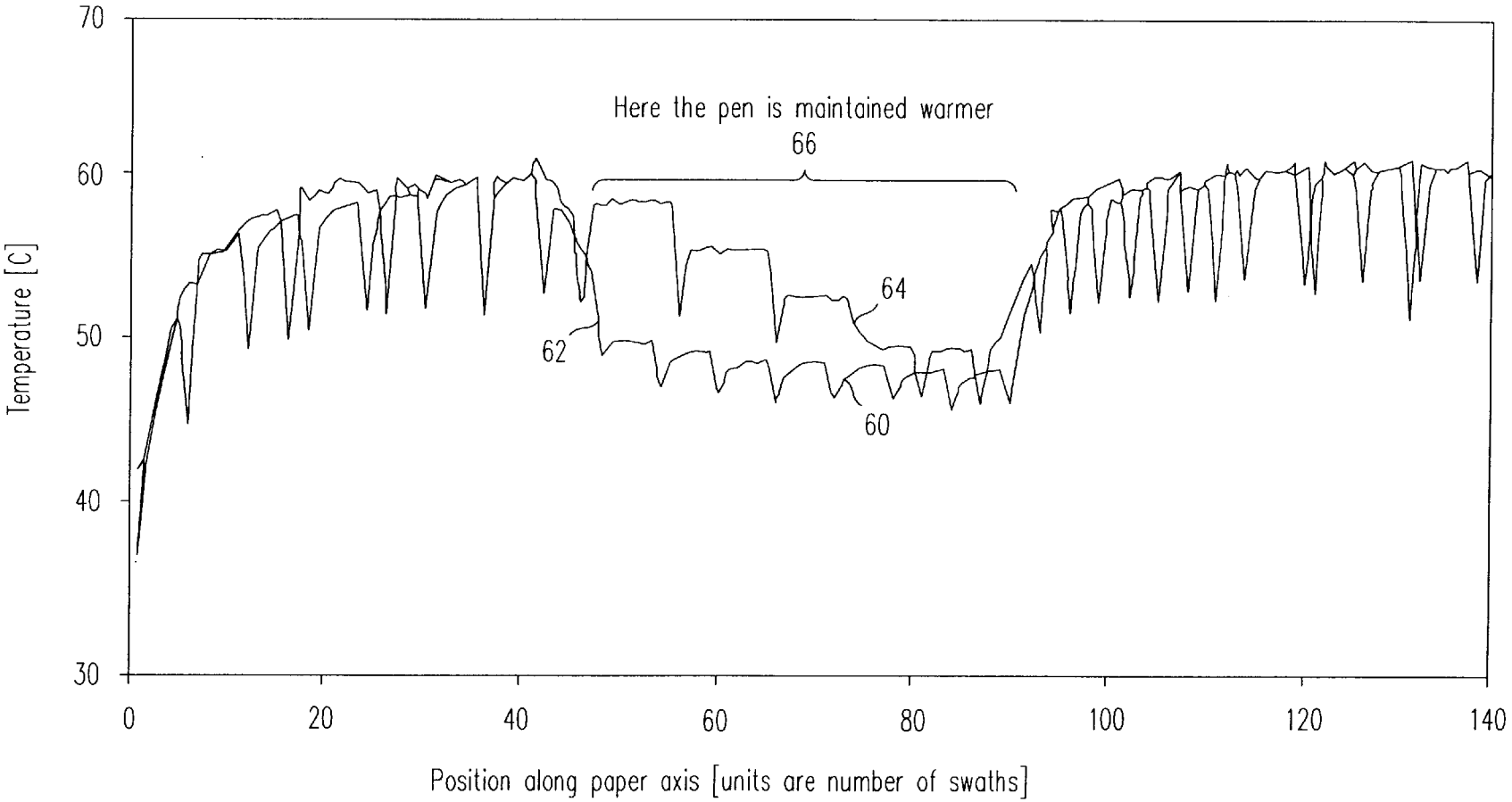
FIG. 4 is a graph illustrating the effect of selectively warming a printhead.

The effect of such warming in accordance with the various embodiments of the present invention is shown in FIG. 4. With reference to FIG. 4, line 60 represents the temperature of a printhead in the absence of the present invention. This temperature may decrease rapidly, such as at point 62, when there is a sudden change in operating conditions/characteristics. At such a point, drop volume for the printhead would also decrease significantly, thus giving rise to pronounced thermal banding effects on a recording medium. In contrast, line 64 represents the temperature of a printhead as selectively warmed by the present invention. Upon the occurrence of rapid changes in operating conditions/characteristics, the printhead is warmed to "smooth" or "filter" the change in temperature, for example, at interval 66. Accordingly, drop volume does not change rapidly, thereby mitigating the effects of thermal banding.

Figure 5:
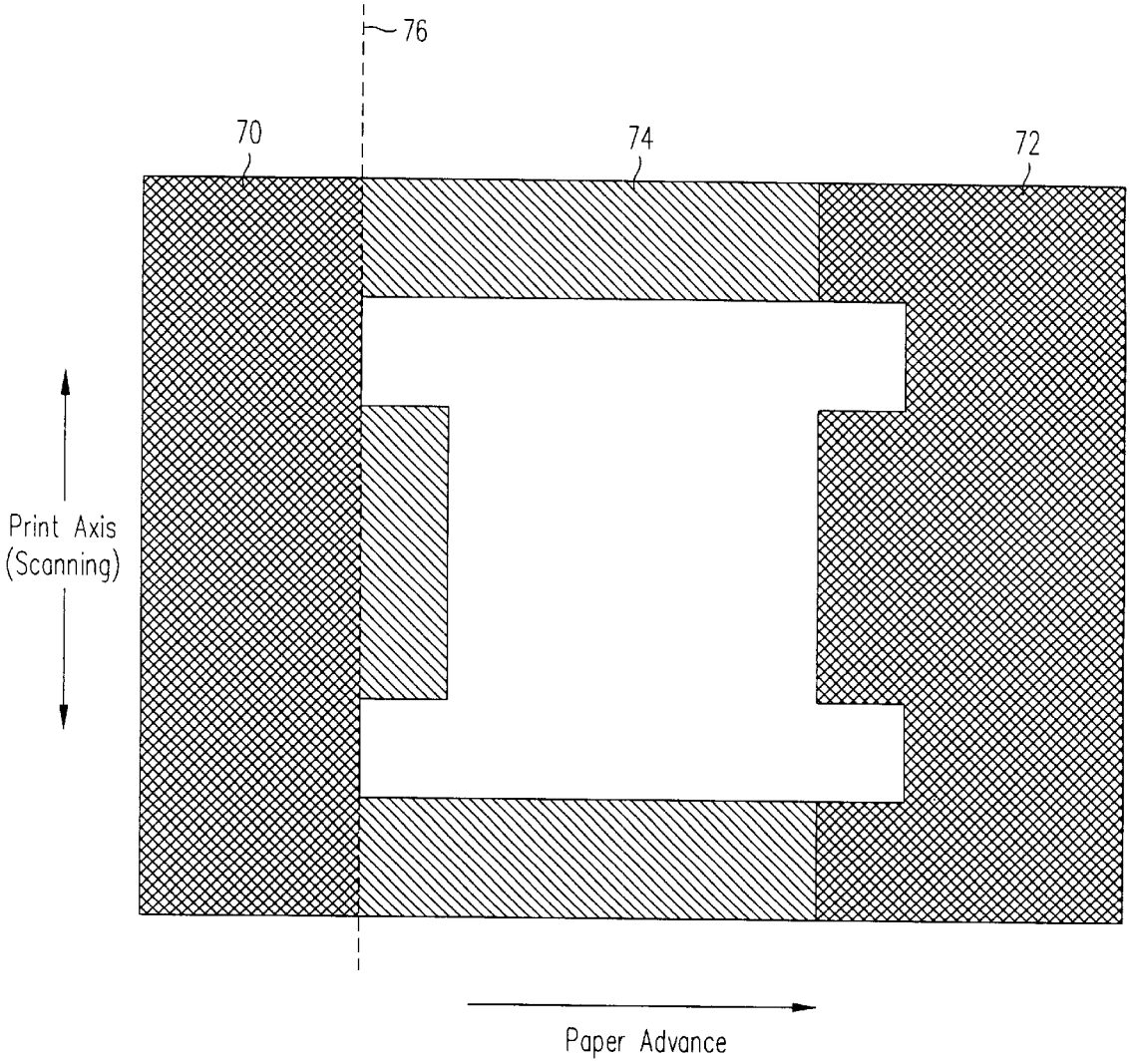
FIG. 5 illustrates the mitigation of thermal banding effects in an exemplary printing of a dark background to define a lightly-colored letter.

FIG. 5 illustrates an exemplary printing of a darkly-colored background to form a lightly-colored letter, in which the effects of thermal banding have been mitigated or substantially reduced by the present invention. In an exemplary operation for the printing of such letter, a printer would be required to print areas 70, 72 of, on average, heavy printing and an area 74 of, on average, light printing. In accordance with one embodiment of the present invention, a printhead for the printer is warmed when there is a sudden change in printing conditions/characteristics, such as, for example, at scan line 76 where the printer would transition from heavy average printing area 70 to light average printing area 74. Because the printhead is controlled to be additionally warmed in the light average printing area, its drop volume does not rapidly change. Accordingly, area 76 does not appear faded or washed out.

Figure 6:
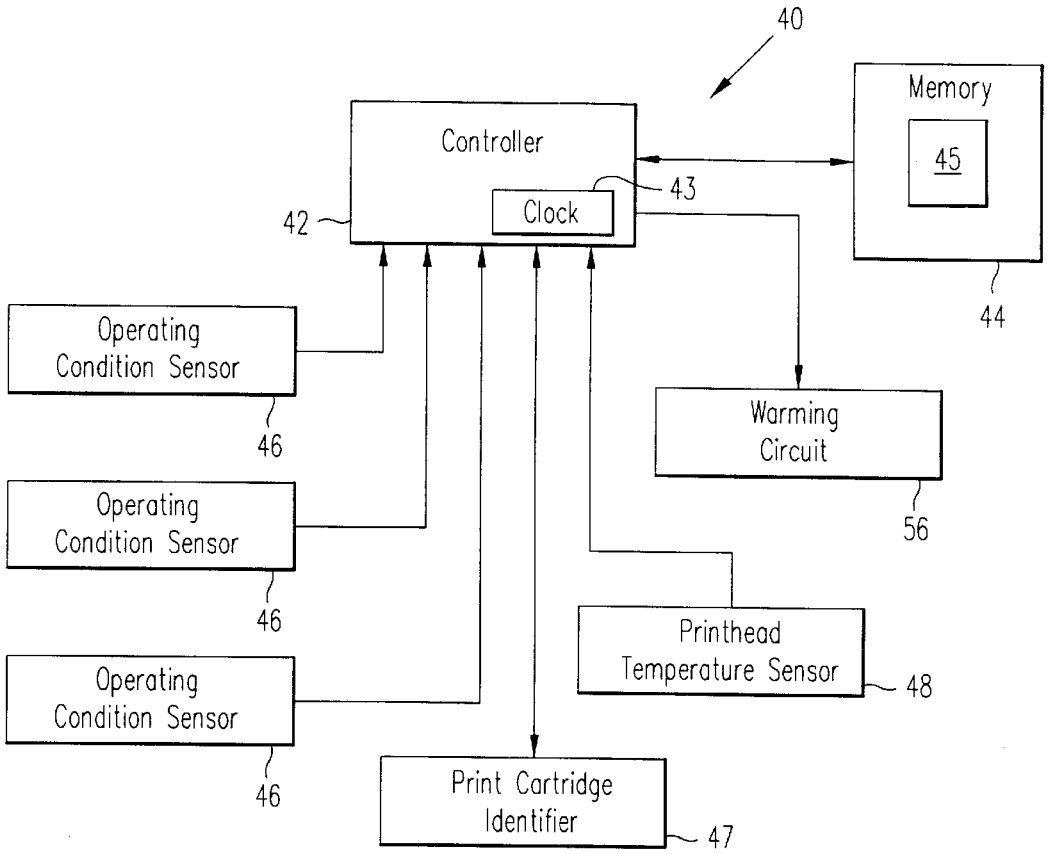
FIG. 6 is a schematic diagram of a system for selectively warming a printhead.

FIG. 6 is a schematic diagram of a system 40 for selectively warming a printhead, in accordance with an embodiment of the present invention. System 40 may be incorporated into an ink jet printer, such as that shown and described with reference to FIG. 2. Referring to FIG. 6, system 40 includes a controller 42 having an associated memory 44. In general, controller 42 functions to control the operation of a printer by, for example, receiving, initiating, issuing, routing, or forwarding different commands, signals, and messages to and from various parts of the printer. Controller 42 may comprise an internal clock 43 for providing timing information thereto. Controller 42 is also capable of performing various calculations. The functionality of controller 42 may be performed by any suitable processor, such as a commercially available microprocessor or one that is resident on an Application Specific Integrated Circuit (ASIC).

Memory 44 is coupled to controller 42 and functions to receive, store, and forward various information 45, such as software code, logic, and data, related to and/or supporting the operation of the printer. In particular, information 45 may comprise information relating to selectively warming the printhead of any print cartridge which may be used with the printer. As described herein, this warming may be in response to relatively sudden changes in any one, or a combination, of various printer conditions/characteristics, such as duty cycle, print density, print speed, and the like, which can be empirically detected, calculated, or predicted. For each type of print cartridge, information 45 may specify a separate predefined interval and predetermined amount of change in one or more relevant operating conditions or characteristics, where such interval and amount of change are used to selectively trigger the warming of a printhead. In addition, information 45 may include a record or history of various values for temperature and the relevant operating condition(s)/characteristic(s) at different points in time. Memory 44, which may comprise a relational database, can reside in any suitable storage medium, such as random access memory (RAM), read-only memory (ROM), disk, tape, or other volatile and/or non-volatile data storage system. It should be understood that memory 44 may also comprise memory internal to, or resident within, controller 42.

One or more operating condition sensors 46 are also coupled to controller 42. Each operating condition sensor 46 functions to detect a particular operating condition within a printer. These operating conditions may include the location of a carriage along a slide rod, the print mode (e.g., fast or slow) for the printer, the number of passes or scans that are to be made in a particular increment of time, the density of a print area (i.e., how much ink is to be deposited onto a particular area of printing), etc. In order to detect these operation conditions, sensors 46 may be implemented from one or a combination of various devices including, but not limited to, optical reflectors, photodetectors, buffers, and memory. Information or signals relating to the operating conditions detected by sensors 46 can be input, forwarded, or relayed to controller 42, either continuously or at the predefined intervals described herein. Using such information or signals, controller 42 may calculate one or more operating characteristics, such as the velocity at which a carriage containing print cartridges moves and the duty cycle for the printer. In addition, controller 42 can calculate or determine the change in each operating condition or characteristic from one moment to another, such as, for example, during a predefined interval. The information collected at operating condition sensors 46 may be stored into memory 44 as part of information 45.

The triggering data described above can be empirically obtained for a particularly printer/printhead combination by anyone skilled in the art. The operating condition sensors 46 may also be easily implemented by those skilled in the art.

A print cartridge identifier 47 is coupled to controller 42 and functions to identify the type of each print cartridge actually incorporated into the printer. To accomplish this, print cartridge identifier 47 may include appropriate sensors, interfaces, circuits, contacts, switches, and the like for mechanical or electronic identification. Alternatively, information regarding the type of each print cartridge can be entered by a user via a suitable interface (e.g., keypad).

Figure 7:
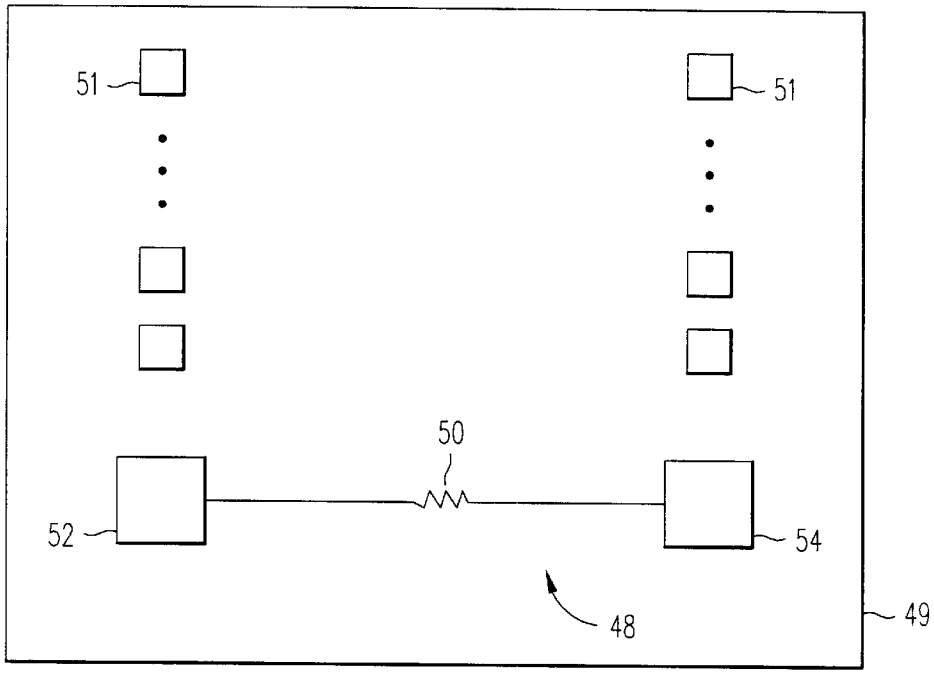
FIG. 7 illustrates an exemplary printhead temperature sensor.

A printhead temperature sensor 48, coupled to controller 42, functions to detect the temperature of a printhead in the printer. In one embodiment, a separate printhead temperature sensor 48 may be provided for each printhead currently incorporated into the printer. Printhead temperature sensor 48 may be implemented using a thermal sense resistor (TSR) formed on the silicon die 49 containing heater resistors 51, as illustrated in FIG. 7. With reference to FIG. 7, printhead temperature sensor 48 may comprise a thermal sense resistor 50 connected between a first contact pad 52 and a second contact pad 54. Each of first and second contact pads 52 and 54 may be a contact pad disposed on a front surface of a flexible polymer circuit (see FIG. 2). The resistance value of thermal sense resistor 50 varies according to the temperature of a printhead. Thus, the printhead temperature may be calculated or derived by applying a known voltage drop across contact pads 52, 54 and measuring the resultant current flowing through thermal sense resistor 50. In another embodiment, a voltage drop across a PN junction is used to determine temperature. Other types of sensors may also be used.

Referring again to FIG. 6, a warming circuit 56 is coupled to controller 42. Warming circuit 56 generally functions to warm, or initiate the warming of, a printhead. In one embodiment, warming circuit 56 comprises an electronic circuit of the type utilized in smart pulse warming (SPW) techniques. Such a circuit fires short bursts of energy into the heating resistors of a printhead. These bursts are not sufficient to vaporize ink (thereby ejecting an unwanted droplet), but do provide enough energy to raise the printhead's temperature.

In an exemplary operation of system 40, memory 44 may be loaded with information 45. This includes information relating to selectively warming the printhead of any print cartridge which may be used with the printer. Afterwards, when the printer is called to execute a print job, operating condition sensors 46 and printhead temperature sensor 48 detect various operating conditions (e.g., carriage location, the number of passes or scans that should be made in a particular increment of time, print area density, etc.) and the printhead temperature of the printer, respectively. Information regarding the detected operating conditions and temperature is relayed or input to controller 42, which may then calculate or derive values for one or more operating characteristics, such as carriage velocity and duty cycle. Using the historical record of operating conditions/characteristics in information 45, controller 42 then calculates the change in one or more relevant operating conditions/characteristics from a previous moment in time. Controller 42 may also determine the increment in time over which such change(s) occurred.

Based upon the actual operating conditions/characteristics (detected and/or calculated), the calculated changes, and the determined time increments, controller 42 may determine whether there has been, within a predefined interval of time, at least a predetermined amount of change in any one, or a combination, of various printer conditions/characteristics. This may be, for example, a rapid decrease in the duty cycle of the printer. If at least the predetermined amount of change has occurred within the predefined interval, controller 42 directs warming circuit 56 to warm up the printhead, for example, by firing energy pulses. Because system 40 prevents the printhead temperature, and hence, the drop volume, from changing rapidly along with sudden changes in operating condition/characteristic, the effects of thermal banding are mitigated.

Furthermore, the present invention contemplates that system 40 may operate robustly to incorporate information that is "learned" over time. Additional details regarding the robust nature, and also the initialization and operation of system 40, are described below with reference to FIGS. 8–10.

Figure 8:
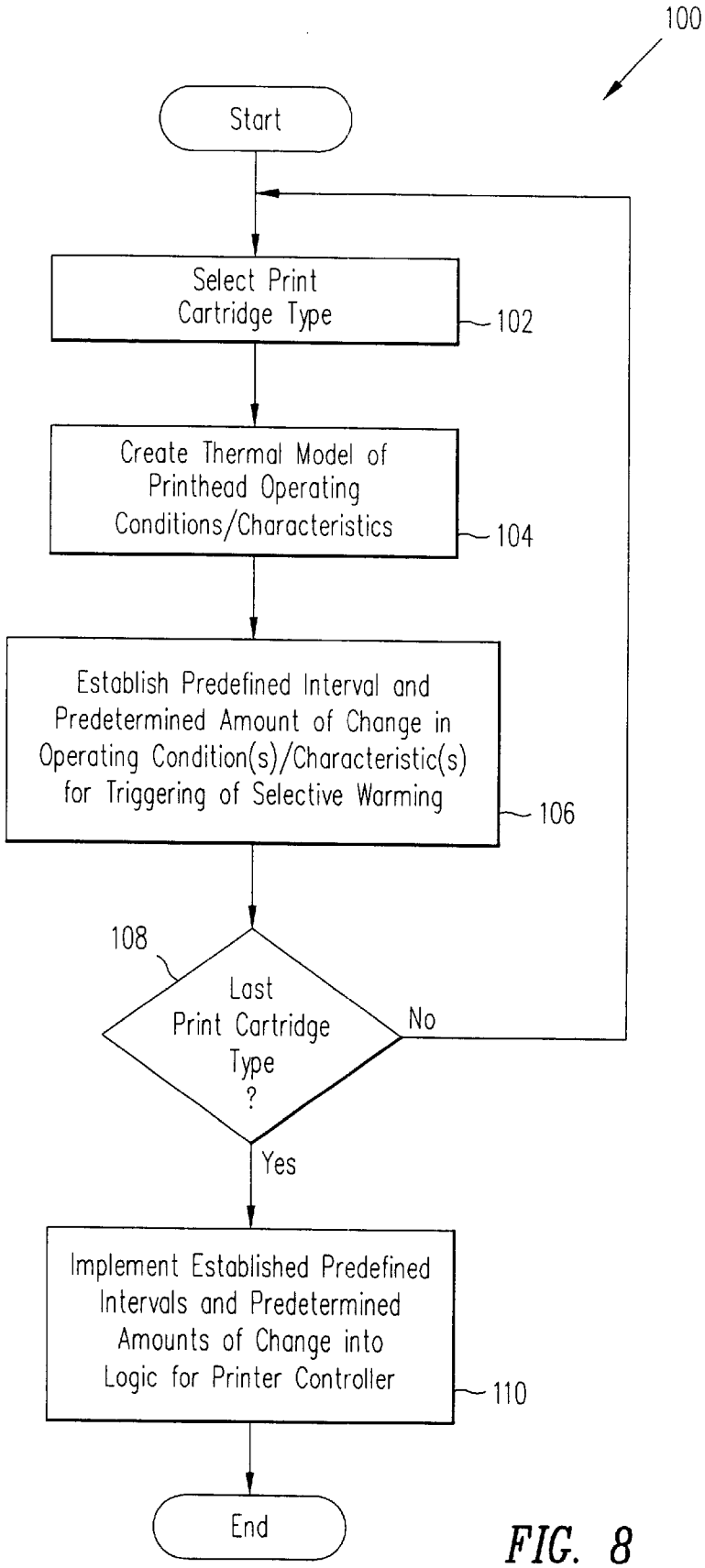
FIG. 8 is a flow chart of a method for initializing a selective warming technique for a printhead.

FIG. 8 is a flowchart of a method 100 for initializing a selective warming technique for a printhead, in accordance with one embodiment of the present invention. Method 100 can be used to initialize system 40 shown in FIG. 6, and may be performed by system 40, or alternatively, by a separate system. This method establishes a predefined interval of time and a predetermined amount of change in operating condition(s)/characteristic(s) at which warming will be triggered for each of a number of different print cartridge types. Each type of print cartridge may have its own, distinct characteristics such that it is affected by a particular set of operating conditions in a way that is different from other print cartridge types.

Method 100 begins at step 102 where a print cartridge type is selected. At step 104, a thermal model for the selected print cartridge type is generated or created, for example, by empirical analysis, for various operating conditions, and operating characteristics calculated therefrom. These operating conditions/characteristics may include any one, or a combination, of print area density, carriage location, carriage velocity, number of passes, duty cycle, or any other suitable operating condition/characteristic. The thermal model embodies the relationship between the operating conditions/characteristics and the temperature of the printhead. Accordingly, the thermal model can be used to determine drop volume of a printhead relative to the operating conditions/characteristics.

Based upon the different operating conditions/characteristics of the thermal model, at step 106 a predefined interval and a predetermined amount of change in operating condition(s)/characteristic(s) is established for triggering the warming of a printhead in the selected print cartridge type.

At step 108, method 100 determines whether the current print cartridge type is the last for which a predefined interval and a predetermined amount of change are to be established. If the current print cartridge type is not the last, method 100 returns to step 102 where another print cartridge type is selected.

Steps 102 through 108 are repeated until a predefined interval and a predetermined amount of change in operating condition(s)/characteristic(s) for all the print cartridge types have been established. When there are no other print cartridge types left, method 100 proceeds to step 110 where the predefined interval and the predetermined amount of change for each print cartridge type, and at least a portion of its thermal model, is implemented into the logic of controller 42 (FIG. 6). Method 100 then ends.

Figure 9:
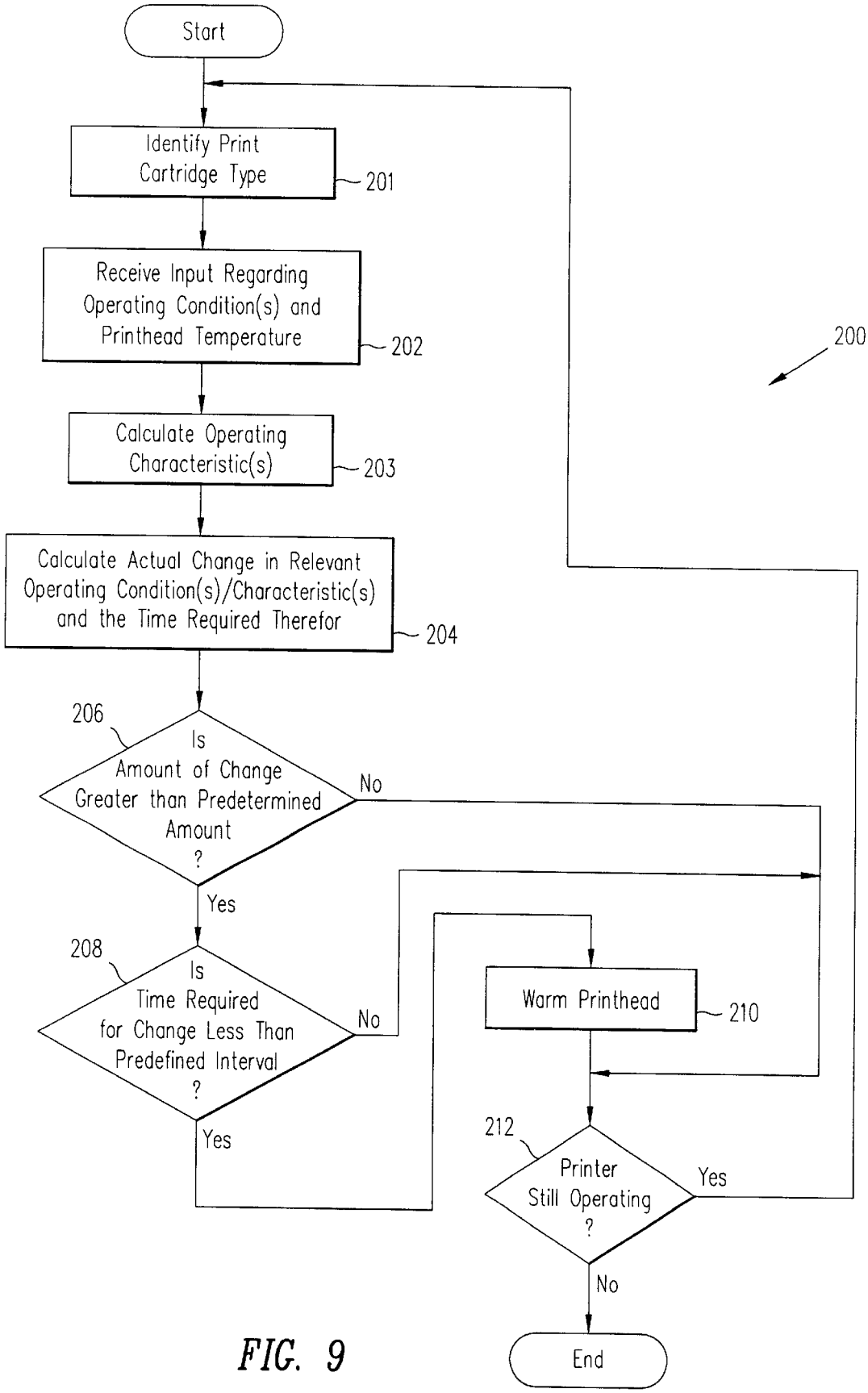
FIG. 9 is a flow chart of a method for operating a printer using a selective warming technique for a printhead.

FIG. 9 is a flowchart of a method 200 for operating a printer using the selective printhead warming technique described herein. In one embodiment, method 200 corresponds to the operation of system 40 (FIG. 6).

Method 200 begins at step 201 where print cartridge identifier 47 identifies the type of each print cartridge actually incorporated into the printer. At step 202, controller 42 receives input regarding various operating conditions (e.g., print area density, carriage location, number of passes, etc.) throughout the printer. This input is collected and forwarded by one or more operating conditions sensors 46. Using this input, controller 42 may calculate values for one or more operating characteristics (e.g., carriage velocity and duty cycle) at step 203. Also a step 202 controller 42 receives input regarding the actual printhead temperature from printhead temperature sensor 48. Based upon the values (either detected or calculated) for the actual operating conditions/characteristics and temperature, controller 42 may determine the predefined interval and predetermined amount of change in operating condition(s)/characteristic(s) for triggering the warming of the printhead under those conditions/characteristics. This can be done, for example, by selecting an appropriate thermal model previously implemented into the controller's logic. Such thermal model, for example, can be specific to a particular type of printer cartridge.

At step 204, controller 42 calculates the actual change in relevant operating condition(s)/characteristic(s) and also the time period over which such change occurred. This can be accomplished by comparing the present values for the relevant operating conditions/characteristics against historical values for the same operating conditions/characteristics, where such historical values are stored as part of information 45 in memory 44.

Next, at step 206, controller 42 determines whether the actual amount of change to the relevant operating condition (s)/characteristic(s) is greater than the predetermined amount of change specified in information 45 stored in memory 44. If not, method 200 moves to step 212. On the other hand, if controller 42 determines that the actual amount of change is greater than the predetermined amount for the relevant operating condition(s)/characteristic(s), then controller 42 proceeds to step 208.

At step 208, controller 42 determines whether the time actually required for the occurrence of the calculated change in the operating condition(s)/characteristic(s) is less than the predefined interval. If not, method 200 moves to step 212. Otherwise, method 200 proceeds to step 210.

At step 210, system 40 warms the printhead. In one embodiment, for example, controller 42 directs or instructs warming circuit 56 to fire one or more short bursts of energy into the heating resistors of a printhead. These bursts are not sufficient to vaporize ink (thereby ejecting an unwanted droplet), but do provide enough energy to raise the printhead's temperature. This prevents the drop volume from rapidly changing, thereby mitigating or substantially reducing the effects of thermal banding.

At step 212, controller 42 determines whether the printer is still operating. If so, method 200 returns to step 202 where controller 42 receives input regarding the actual operating conditions/characteristics of the printer and the printhead temperature. Otherwise, if the printer is no longer operating, method 200 ends.

Figure 10:
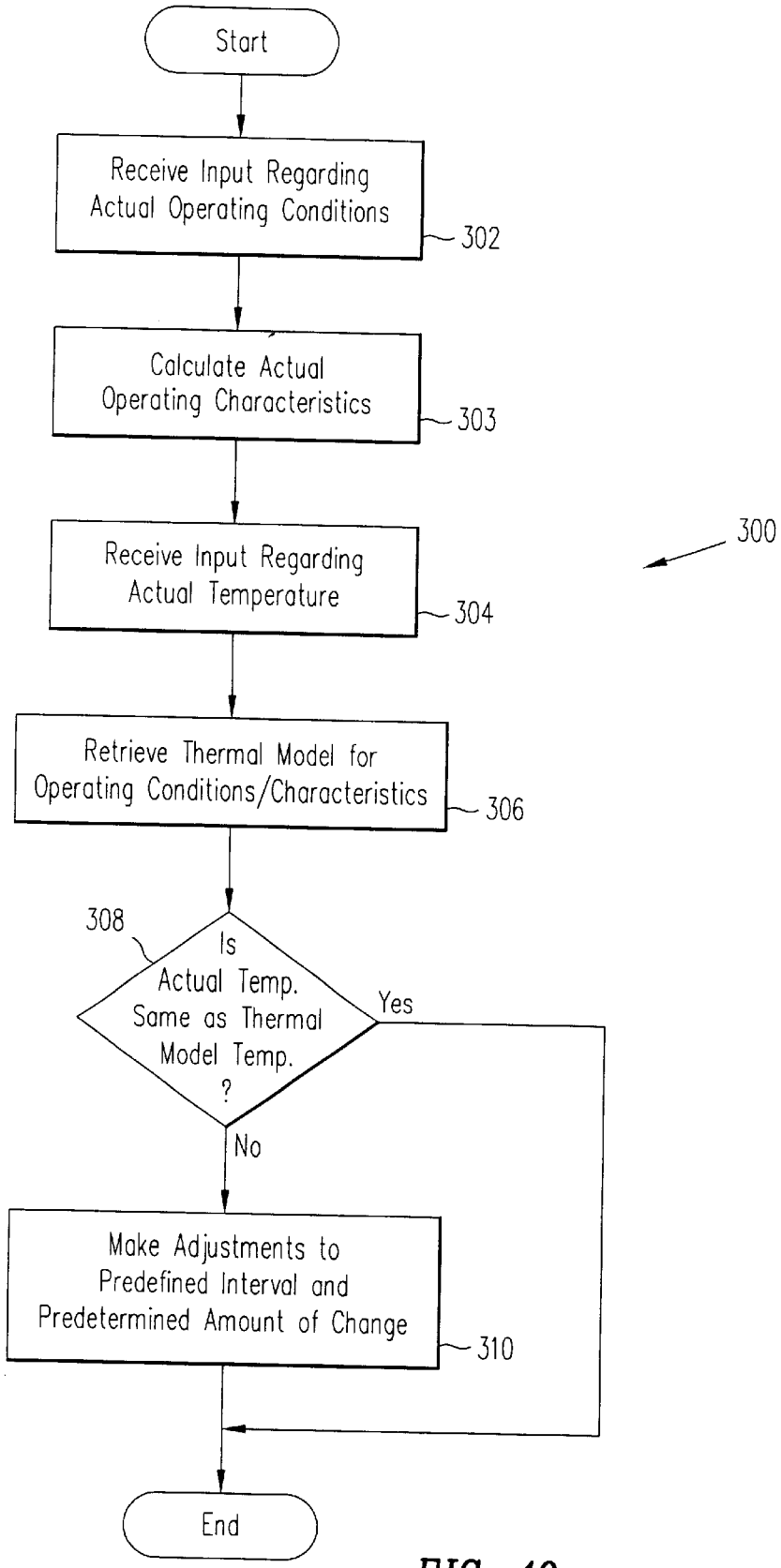
FIG. 10 is a flow chart of a method for robustly changing the triggering events at which a printhead is warmed.

FIG. 10 is a flowchart of a method 300 for robustly changing the triggering events at which a printhead is warmed according to the operation of a specific print cartridge. Method 300 may be performed during an initialization period that begins when a new print cartridge is inserted into a printer. Here, the predefined time interval and predetermined amount of change in relevant operating condition (s)/characteristic(s) for a particular print cartridge type, as established by method 100 described with reference to FIG. 8, may be used as an initial default for each print cartridge of that type. However, the specific operating characteristics of a particular cartridge may be "learned," and the predefined interval and predetermined amount of change adjusted accordingly, under method 300. Method 300 may also be performed at various times after initial insertion into the printer so that the predefined interval and predetermined amount of change are routinely adjusted to account for changes in the operating characteristics of the cartridge.

Method 300 begins at step 302 where input regarding the actual operating conditions of a particular print cartridge is received by controller 42. At step 304, controller 42 receives input regarding the actual temperature of a printhead for the print cartridge under those operating conditions.

At step 306, controller 42 retrieves a thermal model for the particular cartridge type. This thermal model specifies a value (which can be empirically derived) for an average printhead temperature corresponding to a cartridge of that type and under the present operating conditions/characteristics. Within this thermal model may be specified a certain temperature for the same operating conditions/characteristics and type of cartridge.

At step 308, controller 42 determines whether the actual temperature of the particular cartridge is the same as the temperature specified in the thermal model for that cartridge type. If not, the thermal model is not accurate for the particular cartridge at hand. Thus, at step 310 controller 42 makes adjustments to the predefined time interval and predetermined amount of change in relevant operating condition(s)/characteristic(s) to account for the characteristics of the particular cartridge. For example, if controller 42 determines that the actual temperature for the particular cartridge is higher than the temperature specified in the thermal model, the value for the predefined time interval could be decreased. Alternatively, if at step 308 it is determined that the actual temperature is the same as that specified in the thermal model, then method 300 skips step 310. Method 300 ends.

Although the present invention and its advantages have been described in detail, it should be understood that various changes, substitutions, and alterations can be made therein without departing from the spirit and scope of the invention as defined by the appended claims.

What is claimed is:

1. A printhead control system comprising:

a printer operating condition sensor, said sensor outputting a present value for an operating condition within a printer;

a memory storing at least one historical value for the operating condition; and a controller coupled to the printer operating condition sensor and the memory, the controller sensing an amount of change in the operating condition between the present and historical values, the controller further initiating warming of a printhead in the printer in response to the sensed amount of change.

2. The system of claim 1, wherein the controller compares the sensed amount of change against a predetermined amount of change.

3. The system of claim 1, wherein the controller determines a time over which the sensed amount of change occurred.

4. The system of claim 3, wherein the controller compares the determined time against a predefined interval.

5. The system of claim 1, wherein the controller calculates operating characteristics of the printer using the present value for the operating condition.

6. The system of claim 1, wherein the memory stores information specifying a predefined interval of time and a predetermined amount of change in the operating condition.

7. The system of claim 6, wherein the controller adjusts the predefined interval and the predetermined amount of change to account for particular operating characteristics of the printhead.

8. The system of claim 1, further comprising a warming circuit coupled to the controller, said warming circuit firing an energy burst into at least one resistor of the printhead to raise the temperature of the printhead.

9. The system of claim 1, further comprising a print cartridge identifier coupled to the controller, the print cartridge identifier identifying the type of each print cartridge incorporated into the printer.

10. The system of claim 9, wherein the controller selects a thermal model corresponding to at least one identified type of print cartridge.

11. The system of claim 9, wherein the controller generates a thermal model corresponding to at least one identified type of print cartridge.

12. A method of printhead control comprising:

determining a present value for an operating condition within a printer;

sensing an amount of change in the operating condition between the present value and a historical value; and warming a printhead in response to the sensed amount of change.

13. The method of claim 12, further comprising comparing the sensed amount of change against a predetermined amount of change.

14. The method of claim 12, further comprising determining a time over which the sensed amount of change occurred.

15. The method of claim 14, further comprising comparing the determined time against a predefined interval.

16. The method of claim 12, further comprising identifying the type of each print cartridge incorporated into the printer.

17. The method of claim 16, further comprising selecting a thermal model corresponding to at least one identified type of print cartridge.

18. The method of claim 16, further comprising generating a thermal model corresponding to at least one identified type of print cartridge.

19. A printer comprising:

a print cartridge having a printhead; and a printhead warming system, said system sensing an amount of change between a present value and a historical value of an operating condition for the printer and warming the printhead in response to the sensed amount of change, wherein said operating condition is one of a duty cycle, print density, print speed, carriage velocity, carriage location, and number of passes.

20. The printer of claim 19, wherein the printhead warming system comprises:

a printer operating condition sensor, said sensor outputting the present value for the operating condition;

a memory storing the historical value for the operating condition; and a controller coupled to the printer operating condition sensor and the memory, the controller initiating warming of the printhead in response to the sensed amount of change.

21. The printer of claim 19, wherein the printhead warming system compares the sensed amount of change against a predetermined amount of change.

22. The printer of claim 19, wherein the printhead warming system determines a time over which the sensed amount of change occurred.

23. The printer of claim 22, wherein the printhead warming system compares the determined time against a predefined interval.

24. The printer of claim 19, wherein the printhead warming system identifies the type of each print cartridge incorporated into the printer.

25. The printer of claim 24, wherein the printhead warming system selects a thermal model corresponding to at least one identified type of print cartridge.

26. The printer of claim 24, wherein the printhead warming system generates a thermal model corresponding to at least one identified type of print cartridge.

* * * * *

UNITED STATES PATENT AND TRADEMARK OFFICE

CERTIFICATE OF CORRECTION

PATENT NO. : 6,390,585 B1
DATED : May 21, 2002
INVENTOR(S) : Schiaffino, Castelltort and Donovan It is certified that error appears in the above-identified patent and that said Letters Patent is hereby corrected as shown below:

Column 1,
Line 44, delete “modem” and insert -- modern --.

Signed and Sealed this

Nineteenth Day of November, 2002

*Attest:*

*Attesting Officer*

JAMES E. ROGAN
*Director of the United States Patent and Trademark Office*